US009115634B2

(12) United States Patent
Triebe et al.

(10) Patent No.: US 9,115,634 B2
(45) Date of Patent: Aug. 25, 2015

(54) ROTARY SLIDE VALVE WITH A THERMOSTATIC BYPASS

(75) Inventors: Steffen Triebe, Reichertshofen (DE); Michael Staiger, Brackenheim (DE); Lars Helling, Ingolstadt (DE); Dieter Lachner, Gaimersheim (DE)

(73) Assignee: AUDI AG, Ingolstadt (DE)

( * ) Notice: Subject to any disclaimer, the term of this patent is extended or adjusted under 35 U.S.C. 154(b) by 692 days.

(21) Appl. No.: 13/318,854

(22) PCT Filed: May 4, 2010

(86) PCT No.: PCT/EP2010/002715

§ 371 (c)(1),
(2), (4) Date: Nov. 4, 2011

(87) PCT Pub. No.: WO2010/127825

PCT Pub. Date: Nov. 11, 2010

(65) Prior Publication Data

US 2012/0055652 A1 Mar. 8, 2012

(30) Foreign Application Priority Data

May 6, 2009 (DE) ..... 10 2009 020 186

(51) Int. Cl.
*F01P 7/14* (2006.01)
*F01P 7/16* (2006.01)
(Continued)

(52) U.S. Cl.
CPC ..... *F01P 7/161* (2013.01); *F04D 15/0022* (2013.01); *F01P 7/16* (2013.01);
(Continued)

(58) Field of Classification Search
CPC ... F01P 2007/146; F01P 2031/00; F01P 7/16; F01P 7/165; F01P 2025/32; F01P 2005/105
USPC ..... 236/12.11, 12.13, 12.15, 92 C, 93 R
See application file for complete search history.

(56) References Cited

U.S. PATENT DOCUMENTS 5,217,085 A * 6/1993 Barrie et al. ..... 184/104.1
5,381,952 A * 1/1995 Duprez ..... 236/34.5
(Continued)

FOREIGN PATENT DOCUMENTS

DE 198 16 522 A1 10/1999
DE 198 31 901 A1 1/2000
(Continued)

*Primary Examiner* — Marc Norman
*Assistant Examiner* — Max Snow
(74) *Attorney, Agent, or Firm* — Henry M. Feiereisen LLC

(57) ABSTRACT

The invention relates to a fail-safe rotary actuator (1) for a coolant circuit, in particular for a coolant circuit of an internal combustion engine (2) having a plurality of sub-circuits (3) and (4), includes a coolant delivery pump (5) for circulating the coolant within the coolant circuit, and having a rotary-slide housing (8) which has a plurality of housing pass-through openings (6) and (7) and in which at least one rotary slide (9) having at least one rotary slide pass-through opening (11) and (12) is rotatably supported, wherein the housing pass-through openings (6) and/or (7) are fluidly connected to at least one sub-circuit (3) and/or (4), and can be brought into at least partial coincidence with the rotary slide pass-through openings (11) and/or (12) by a rotary motion of the rotary slide (9), wherein a thermostat valve (13) opens a flow path running parallel to the rotary slide (9) from one of the sub-circuits (3) or (4) to the coolant delivery pump (5), when a temperature limit of the coolant is exceeded.

16 Claims, 3 Drawing Sheets

(51) Int. Cl.
*F04D 15/00* (2006.01)
*F01P 5/10* (2006.01)

(52) U.S. Cl.
CPC ..... *F01P 7/165* (2013.01); *F01P 2005/105* (2013.01); *F01P 2007/146* (2013.01); *F01P 2025/32* (2013.01); *F01P 2031/00* (2013.01)

(56) References Cited

U.S. PATENT DOCUMENTS

| | | | | |
|---|---|---|---|---|
| 5,529,026 | A * | 6/1996 | Kurr et al. | 123/41.1 |
| 5,642,691 | A * | 7/1997 | Schroeder | 123/41.09 |
| 5,809,944 | A * | 9/1998 | Aoki et al. | 123/41.02 |
| 5,950,576 | A * | 9/1999 | Busato et al. | 123/41.08 |
| 6,047,895 | A * | 4/2000 | Pastleitner et al. | 236/34.5 |
| 6,481,387 | B1 * | 11/2002 | Sano | 123/41.1 |
| 6,913,241 | B2 | 7/2005 | Bernarding et al. | |
| 7,681,803 | B2 * | 3/2010 | Knapp | 236/12.13 |
| 8,534,569 | B2 * | 9/2013 | Hamaguchi | 236/34.5 |
| 2001/0013553 | A1 * | 8/2001 | Chamot et al. | 236/12.11 |
| 2003/0070714 | A1 * | 4/2003 | Babin | 137/599.11 |
| 2003/0150406 | A1 * | 8/2003 | Takagi et al. | 123/41.1 |
| 2004/0221577 | A1 * | 11/2004 | Yamaguchi et al. | 60/520 |
| 2005/0034688 | A1 * | 2/2005 | Lelkes et al. | 123/41.01 |
| 2005/0106040 | A1 | 5/2005 | Repple et al. | |
| 2005/0228571 | A1 * | 10/2005 | Odeskog et al. | 701/103 |
| 2005/0268866 | A1 * | 12/2005 | Finkbeiner et al. | 123/41.1 |
| 2006/0005789 | A1 * | 1/2006 | Miura et al. | 123/41.1 |
| 2007/0028862 | A1 * | 2/2007 | Braun et al. | 123/41.1 |
| 2007/0234978 | A1 * | 10/2007 | Pipkorn et al. | 123/41.08 |
| 2008/0251591 | A1 * | 10/2008 | Miyamoto et al. | 236/99 K |
| 2008/0295785 | A1 * | 12/2008 | Harris et al. | 123/41.08 |
| 2009/0229542 | A1 * | 9/2009 | Haas et al. | 123/41.1 |
| 2009/0255488 | A1 * | 10/2009 | Shiobara et al. | 123/41.1 |
| 2010/0095908 | A1 * | 4/2010 | Deivasigamani | 123/41.1 |
| 2011/0005474 | A1 * | 1/2011 | Carlson et al. | 123/41.1 |
| 2011/0247575 | A1 * | 10/2011 | Heldberg | 123/41.08 |
| 2012/0048217 | A1 * | 3/2012 | Triebe et al. | 123/41.1 |
| 2012/0111956 | A1 * | 5/2012 | Kinomura et al. | 236/93 R |
| 2012/0137992 | A1 * | 6/2012 | Kinomuka et al. | 123/41.08 |

FOREIGN PATENT DOCUMENTS

| | | | |
|---|---|---|---|
| DE | 199 21 421 | A1 | 11/2000 |
| DE | 100 37 823 | A1 | 2/2002 |
| DE | 101 55 386 | A1 | 5/2003 |
| DE | 102 26 928 | A1 | 1/2004 |
| DE | 102 43 778 | A1 | 3/2004 |
| JP | 2000-303842 | | 10/2000 |
| WO | WO 03/042517 | | 5/2003 |

* cited by examiner (a)

(b)

ROTARY SLIDE VALVE WITH A THERMOSTATIC BYPASS

CROSS-REFERENCES TO RELATED APPLICATIONS

This application is the U.S. National Stage of International Application No. PCT/EP2010 /002715, filed May 4, 2010, which designated the United States and has been published as International Publication No. WO 2010/127825 and which claims the priority of German Patent Application, Serial No. 10 2009 020 186.6, filed May 6, 2009, pursuant to 35 U.S.C. 119(a)-(d).

BACKGROUND OF THE INVENTION

Fail-safe rotary actuator for a coolant circuit for preventing damages to an internal combustion engine as a result of inadequate cooling capacity when the rotary actuator fails.

Such rotary actuators are preferably used for providing an emergency operation of the coolant circuit of an internal combustion engine in the event coolant controlled by the rotary actuator is no longer sufficient to reliably cool the internal combustion engine as result of a malfunction of the rotary actuator.

DE 102 43 778 A1 discloses an actuating device with an electromotive rotary drive, via which an actuating element, in particular a rotary slide of a rotary-slide valve can be driven rotatably about an axis of rotation between a first end position and a second end position and can be acted upon out of the first end position by a spring. The electromotive actuating drive is hereby designed as reversing drive and the spring action upon the actuating element is effective only between the first end position and an intermediate position, with the intermediate position lying between the first end position and the second end position. In the event the actuating element designed as a rotary-slide valve is a regulating valve in a coolant circuit of an internal combustion engine, the rotation of the actuating element as a result of the spring action upon the actuating element maintains a cooling of the internal combustion engine during emergency operation, when the electromotive rotary drive fails.

The disclosed actuating device is, however, disadvantageous because the emergency operation is triggered immediately after failure of the rotary drive as a result of the constantly present spring action upon the actuating element. As a consequence, depending on the ambient temperature, motor load, and travel speed, the coolant can no longer heat up to the operating temperature, causing the internal combustion engine to run less efficient during emergency operation.

SUMMARY OF THE INVENTION

It is an object of the present invention to provide a fail-safe rotary actuator for a coolant circuit which is able to initiate emergency operation for the coolant when needed.

This object is attained by a fail-safe rotary actuator for a coolant circuit, in particular for a coolant circuit of an internal combustion engine having a plurality of sub-circuits, including a coolant delivery pump for circulating the coolant within the coolant circuit, and a rotary-slide housing which has a plurality of housing pass-through openings and in which at least one rotary slide having at least one rotary-slide pass-through opening is rotatably supported, wherein the housing pass-through openings are fluidly connected to at least one sub-circuit and can be brought into at least partial coincidence with the rotary-slide pass-through openings by a rotary motion of the rotary slide, and wherein a thermostat valve opens a flow path running parallel to the rotary slide from one of the sub-circuits to the coolant delivery pump, when a temperature limit of the coolant is exceeded.

By arranging in parallel relation to the rotary slide a thermostat valve which is controllable in temperature-dependent manner, an emergency operation is ensured in the event of a failure of the rotary-slide control by having the thermostat valve for the coolant open an alternative flow path to the coolant delivery pump. As a result of the temperature-dependent control of the thermostat valve, this flow path is activated only when the temperature of the coolant has reached a temperature limit that is critical for the operation of the internal combustion engine. In this way, the internal combustion engine is not prevented from reaching the operating temperature, despite a malfunction of the rotary actuator, thus contributing to a reduction in fuel consumption and emissions. Furthermore, the rotary actuator is very rugged because any components that are required for the emergency operation are prevented from directly engaging the rotary actuator so as to enable easy mobility of the rotary slide and little component wear. Also the thermostat valve is subject to very little wear as it has to be actuated only very infrequently.

According to a preferred embodiment, a radiator supply line conducts coolant from the internal combustion engine to a heat exchanger, and a radiator return line conducts coolant exiting the heat exchanger to the rotary slide. Coolant heated by the internal combustion engine is conducted by the radiator supply line to the heat exchanger where it can cool down. Cooled coolant exiting the heat exchanger is conducted via the radiator return line to the respective housing pass-through opening of the rotary slide. A bypass may also branch off the radiator supply line and conduct heated coolant to a further housing pass-through opening. By rotating the rotary slide, its rotary-slide pass-through openings may at least in part coincide with the respective housing pass-through openings. Thus, it is possible to precisely adjust the proportion of coolant flowing from the bypass and the radiator return line into the rotary slide.

According to a preferred embodiment, the thermostat valve is controlled in response to a comparison of the temperature of the coolant in the radiator supply line with the temperature limit of the coolant. By comparing the temperature of the heated coolant in the radiator supply line with the specific temperature limit, a critical increase of the coolant temperature of coolant in the internal combustion engine can be more rapidly responded to. Furthermore, the temperature measurement is thereby independent from the momentarily attainable cooldown rate of the downstream heat exchanger, which cooldown rate may significantly vary during operation.

According to a preferred embodiment, the thermostat valve has a shut-off valve which is supported in a valve seat and pressed snugly by a spring against the valve seat, and a push rod which is arranged on the shut-off valve and actuatable by an expansion member, wherein the expansion member which is in communication with the coolant of the radiator supply line expands when the temperature limit of the coolant is reached and lifts the shut-off valve away from the valve seat via the push rod in opposition to the pressure of the spring. As the thermostat valve includes an expansion member, preferably in the form of a wax capsule, in contact with the coolant from the radiator supply line, the temperature limit can be monitored and maintained in the absence of any additional electronics. Determinative for the temperature limit is rather the material properties of the used wax which expands when reaching the temperature limit, and as a result applies a force onto the attached push rod. The shut-off valve, preferably configured as poppet valve, is mounted on the other end of the push rod and is pressed snugly by a spring against a complementary valve seat. When the expansion member applies a force upon the push rod, the shut-off valve is lifted away from the valve seat, thereby opening a flow path in parallel relation to the rotary slide.

According to a preferred embodiment, the thermostat valve has chambers arranged on opposite sides of the shut-off valve and acted upon by coolant, with a first chamber receiving coolant from the radiator return line, and a second chamber having a fluid communication to the suction port of the coolant delivery pump. The chambers are configured preferably as cages so that coolant can enter and exit in an easiest possible manner. The first chamber is filled at all times with coolant from the radiator return line whereas the second chamber contains mostly coolant from the rotary slide.

According to a preferred embodiment, a gap is formed between the rotary slide and the rotary-slide housing for allowing flow of coolant from the second chamber of the thermostat valve to the suction port of the coolant delivery pump. Coolant may flow through the formed annular gap to the suction port of the coolant delivery pump, regardless of the momentary position of the rotary slide. Additional radial through openings in the rotary slide may facilitate the transfer of coolant from the second chamber of the thermostat valve into the rotary slide.

According to a preferred embodiment, the coolant delivery pump conveys coolant drawn in from the rotary slide to a heating circuit and/or a supply line to the internal combustion engine.

According to a preferred embodiment, a heating heat exchanger and/or a heating delivery pump and/or a heating shut-off valve is/are arranged in the heating circuit. As coolant flows in addition to the heat exchanger also through the heating heat exchanger, the available cooling surface is increased. The heating deliver pump is preferably operated electrically and is thus able to convey coolant through the cooling circuit in addition to the coolant delivery pump in case of need. The heating shut-off valve can be closed when no heating capacity is needed, resulting during normal operation in a more rapid heat-up of coolant in the remaining sub-circuits.

According to a preferred embodiment, a further shut-off valve, in particular a further rotary slide, is arranged in the supply line to the internal combustion engine. As a result of the arrangement of a further shut-off valve in the supply line to the internal combustion engine, coolant flow to the internal combustion engine can be interrupted in case of need and diverted to the heating circuit in a targeted manner. By configuring the further shut-off valve as rotary slide, a direct or indirect connection with the other rotary slide enables a rotary motion in dependence from one another.

According to a preferred embodiment, the heating shut-off valve is opened, when the temperature limit of the coolant is exceeded so that the coolant from the coolant delivery pump can be conveyed via the heating heat exchanger to the internal combustion engine. This is especially necessary, when the further shut-off valve, configured as rotary slide, is no longer capable to allow flow of coolant in the supply line to the internal combustion engine as a result of a malfunction. In this case, it is necessary to conduct a coolant flow from the rotary actuator via the heating circuit back to the internal combustion engine.

The following description of a preferred exemplary embodiment provides further details, features and advantages of the invention with reference to the drawings.

BRIEF DESCRIPTION OF THE DRAWING

It is shown in.

DETAILED DESCRIPTION OF PREFERRED EMBODIMENTS

Figure 1:
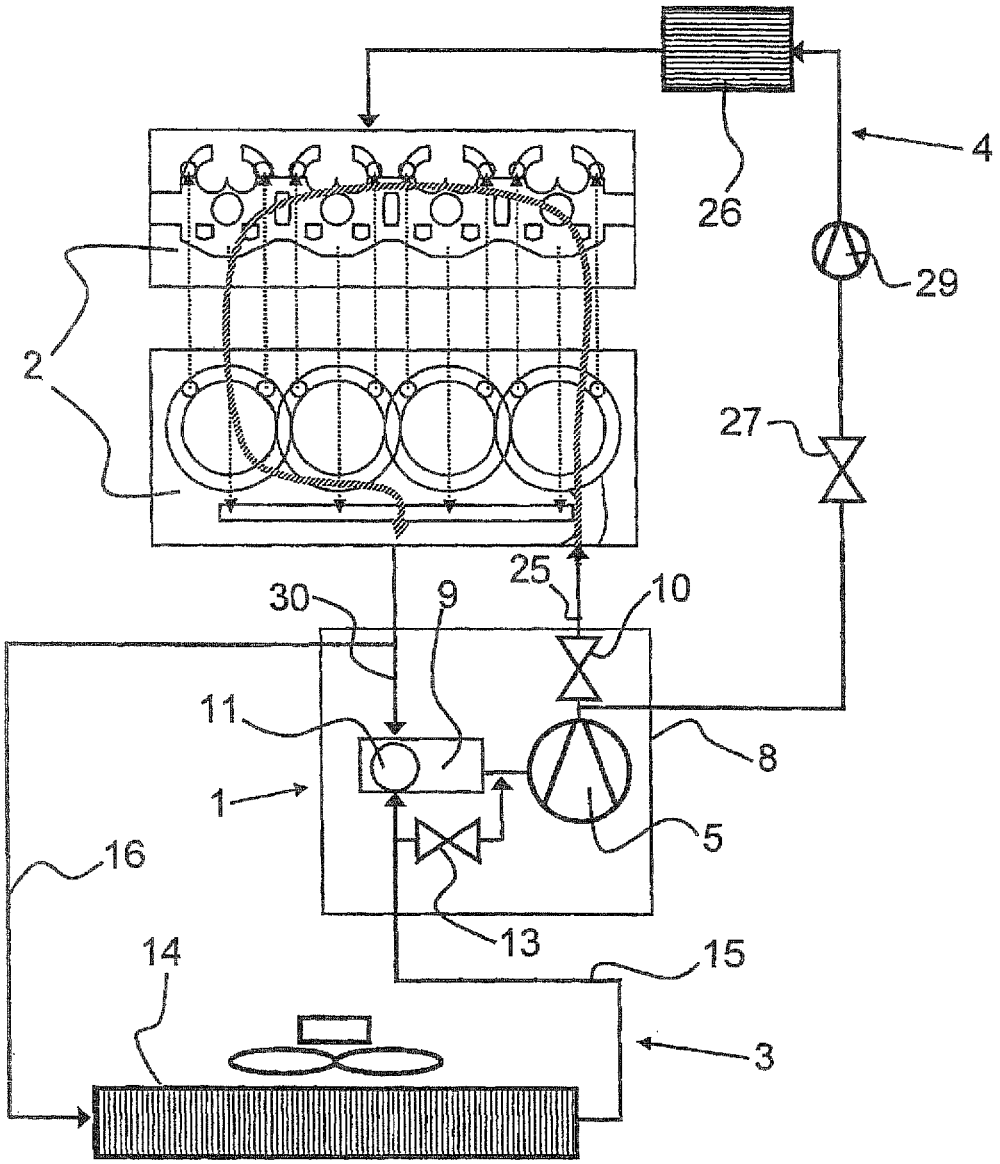
FIG. 1 a schematic illustration of the arrangement of a fail-safe rotary actuator in the coolant circuit.

According to FIG. 1, an internal combustion engine 2 is acted upon by coolant from several sub-circuits, in particular a primary cooling circuit 3 and a heating circuit 4. The internal combustion engine 2 includes essentially a cylinder head and a cylinder crankcase which are flushed by coolant located in a water jacket, with the heat quantity developing during combustion of fuel at least in part being transferred onto the coolant. Arranged in the cooling circuit is a fail-safe rotary actuator 1 by which the coolant flows of the respective sub-circuits 3 and 4 can be controlled according to demand. The rotary actuator 1 includes at least a rotary slide 9 which is rotatably supported in a rotary-slide housing 8. The rotary-slide housing 8 has a multiplicity of housing pass-through openings which can be brought to at least partial coincidence with the respective rotary-slide pass-through openings 11 of the rotary slide 9 through a rotary motion. Disposed in the rotary actuator 1 is a coolant delivery pump 5 having a suction port which can receive coolant from the rotary slide 9 for supply into the heating circuit 4 and supply line 25 to the internal combustion engine. The delivery capacity of the coolant delivery pump 5 and the distribution of the coolant volume flows in the individual sub-circuits 3 and 4 can be regulated by a rotation of the rotary slide 9 in combination with an operation of the shut-off valve 10 arranged in the supply line 25 to the internal combustion engine. The shut-off valve 10 may also be configured as further rotary slide and coupled to the movement of the rotary valve 9. The primary cooling circuit 3 conducts coolant from the internal combustion engine 2 via the radiator supply line 16 to a heat exchanger 14 and a housing pass-through opening of the bypass 30. Coolant exiting the heat exchanger 14 flows via the radiator return line 15 to the housing pass-through opening of the rotary-slide housing 8. Depending on the position of the first rotary slide 9 in relation to the rotary-slide housing 8, incoming coolant can flow from the bypass 30 and the radiator return line 15 at variable flow rate into the rotary slide 9 or the inflow is hindered. This may, for example, be the case in the event of a failure of the rotary-slide drive and would cause inadequate cooling of the connected internal combustion engine 2. Therefore, a thermostat valve 13 is associated to the rotary slide 9 to open, in case of need, especially when the temperature limit of the coolant in the radiator supply line 16 is exceeded, a parallel flow path which circumvents the rotary slide 9. When the thermostat valve 13 is open, coolant from the radiator return line 15 can bypass the rotary slide 9 and flow to the suction port 24 of the coolant delivery pump 5. The coolant delivery pump 5 conveys coolant to the supply line 25 to the internal combustion engine and the heating circuit 4, with the heating circuit 4 including a heating shut-off valve 27, a heating delivery pump 29, and a heating heat exchanger 26. The heating shut-off valve 27 is open, preferably during emergency operation, and the electrically powered heating delivery pump 29 is able to provide additional delivery capacity, when the delivery capacity of the coolant delivery pump 5 is too small. Thus, a coolant flow can be maintained through the heat exchanger 14 and/or the heating heat exchanger 26, irrespective of the momentary position of the rotary slide 9 and the shut-off valve 10.

Figure 2:
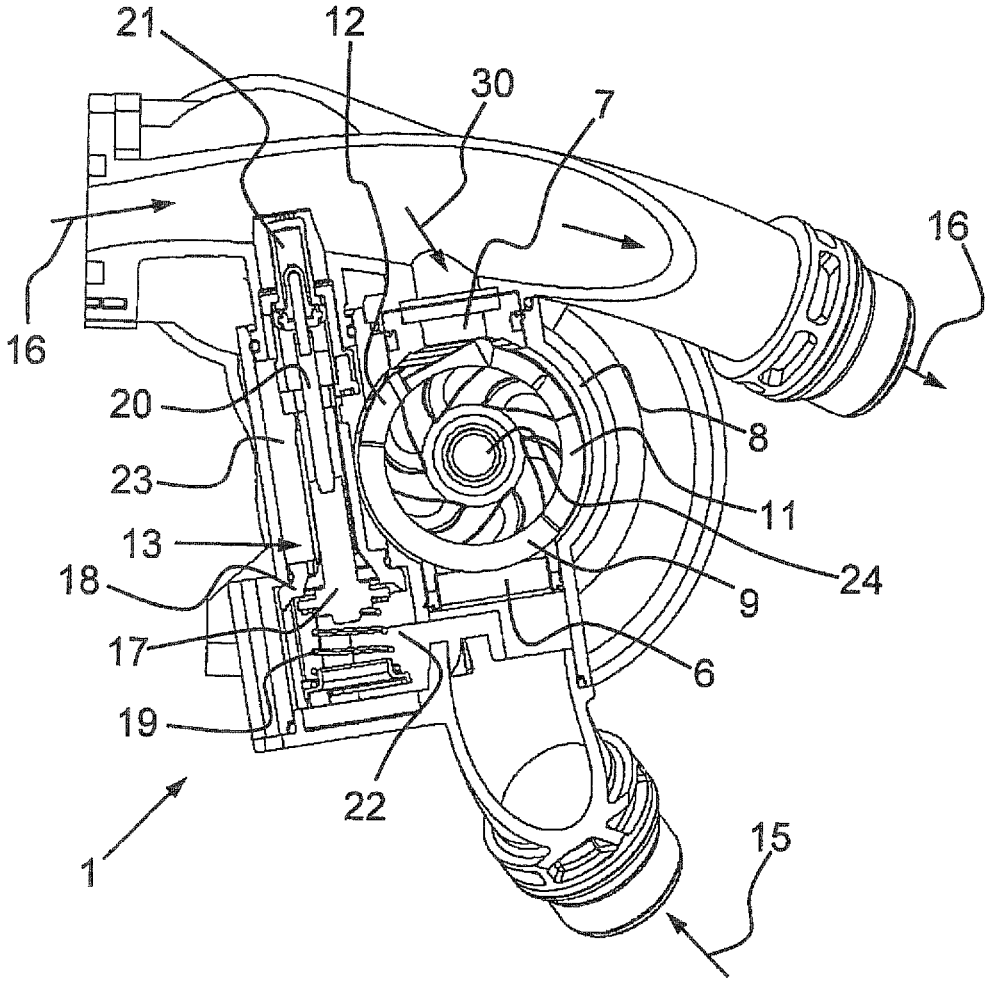
FIG. 2 a sectional view of a fail-safe rotary actuator.

According to FIG. 2, a fail-safe rotary slide 1 for a coolant circuit includes a rotary-slide housing 8 in which a rotary slide 9 is supported for rotary motion. The rotary-slide housing 8 has several housing pass-through openings 6 and 7, in particular a housing pass-through opening 6 which can receive coolant from the radiator return line 15, and a housing pass-through opening 7 which can receive coolant from the bypass 30, with the bypass 30 branching off the radiator supply line 16. The rotary slide 9 has several rotary-slide pass-through openings 11 and 12, in particular a rotary-slide pass-through opening 11 which is associated with the housing pass-through opening of the radiator return line 15, and a rotary-slide pass-through opening 12 which is associated to the housing pass-through opening of the bypass 30, with a rotary motion of the rotary slide 9 causing the rotary-slide pass-through openings 11 and/or 12 to at least partly coincide with the housing pass-through openings 6 and/or 7. Arranged on the rotary slide 9 is a thermostat valve 13 having an expansion member 21 which is configured as wax capsule and arranged in the radiator supply line 16 and which expands when a specific temperature limit of the coolant is exceeded. A push rod 20 is arranged on the expansion member 21 and has on one end a shut-off valve 17 which is pressed snugly against a valve seat 18 by a spring 19. Chambers 22 and 23 are formed on both sides of the shut-off valve 17, with a first chamber 22 fluidly communicating below the shut-off valve 17 with the radiator return line 15, and with a second chamber 23 above the shut-off valve 17 in fluid communication with the suction port 24 of a coolant delivery pump 5, irrespective of the momentary position of the rotary slide 9.

Figure 3:
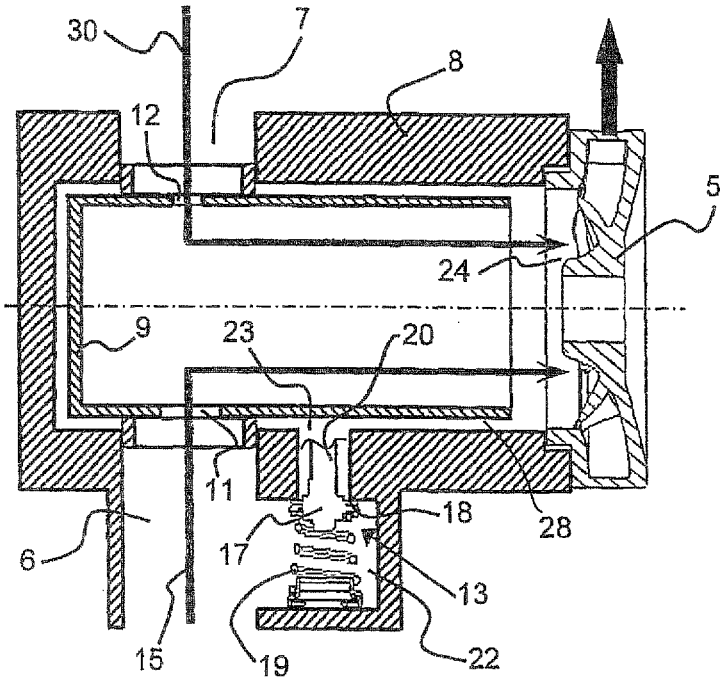
FIG. 3 a sectional view of a fail-safe rotary actuator with closed (FIG. 3*a*) and open (FIG. 3*b*) thermostat valve.
Figure 3:
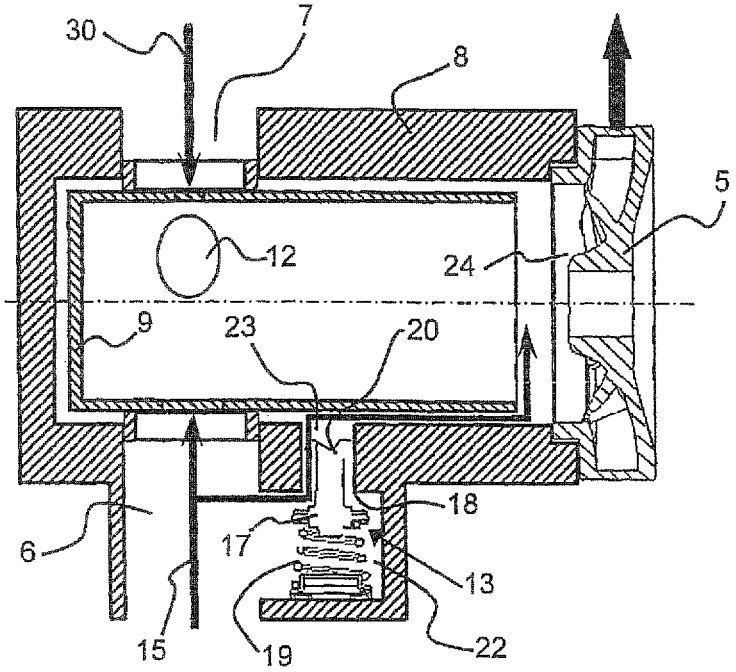

According to FIG. 3, a fail-safe rotary actuator for a coolant circuit includes a rotary-slide housing 8 in which a rotary slide 9 is supported for rotary motion. The rotary-slide housing 8 has several housing pass-through openings 6 and 7, in particular a housing pass-through opening 6 which can receive coolant from the radiator return line 15, and a housing pass-through opening 7 which can receive coolant from the bypass 30. The rotary slide 9 has several rotary-slide pass-through openings 11 and 12, in particular a rotary-slide pass-through opening 11 for the radiator return line 15, and a rotary-slide pass-through opening 12 for the bypass 30, with a rotary motion of the rotary slide 9 causing the rotary-slide pass-through openings 11 and/or 12 to at least partly coincide with the housing pass-through openings 6 and/or 7. When, as shown in FIG. 3*a*, at least one rotary-slide pass-through opening 11 or 12 coincides with at least one housing pass-through opening 6 or 7, coolant can migrate to the rotary slide 9 and can be drawn in by the suction port 24 of the coolant delivery pump 5. In the absence of a coincidence of the rotary-slide pass-through opening 11 or 12 with a housing pass-through opening 6 or 7, as shown in FIG. 3*b*, no coolant can flow into the rotary slide 9 and therefore cannot reach the suction port 24 of the coolant delivery pump 5. This may, for example, be the case in the event of a failure of the rotary-slide drive, which would lead to inadequate cooling of the connected internal combustion engine. A thermostat valve 13 is therefore arranged on the rotary slide 9 to open or close in dependence on the temperature of coolant located in a radiator supply line, in particular closes at a temperature below a temperature limit (FIG. 3*a*), and opens at a temperature above a temperature limit (FIG. 3*b*). A shut-off valve 17 is hereby pressed snugly against a valve seat 18 by a spring 19. When the temperature limit is exceeded, an expansion member forces the shut-off valve 14 via a push rod 20 away from the valve seat 18 so as to establish an alternative flow path for coolant. In this case, coolant from the radiator return line 15 is able to flow from the first chamber 22 into the second chamber 23 of the thermostat valve 13 and from there can flow via the gap 28 between the rotary slide 9 and the rotary-slide housing 8 to the suction port 24 of the coolant delivery pump 5. As an alternative, it is possible to provide the rotary slide 9 in this region with further radially dispersed pass-through openings to allow coolant from the second chamber to more easily migrate into the rotary slide 9, thereby enabling a better delivery capacity of the coolant delivery pump 5 during emergency operation.

The invention claimed is:

1. A fail-safe rotary actuator for a coolant circuit, comprising:

a pump for circulating a coolant within the coolant circuit;

a rotary-slide housing having a plurality of housing pass-through openings which are fluidly connected to a sub-circuit of the coolant circuit, the sub-circuit having a radiator, an inlet line, and an outlet line, the plurality of housing pass-through openings including 1) an opening that accepts fluid form the inlet line, 2) an opening that accepts fluid from the outlet line, and 3) an opening that delivers fluid to the pump;

at least one rotary slide valve having at least one rotary slide pass-through opening and supported in the rotary-slide housing for rotation to enable at least partial coincidence of the housing pass-through openings with the rotary slide pass-through opening; and a thermostat valve adapted to open a flow path running parallel to the rotary slide from the outlet line directly to the pump, when a temperature limit of the coolant in the inlet line is exceeded as detected by an expansion member of said thermostat valve, said expansion member in communication with the coolant in the inlet line by extending into the inlet line.

2. The fail-safe rotary actuator of claim 1, constructed for a coolant circuit of an internal combustion engine, with the coolant circuit having a plurality of sub-circuits.

3. The fail-safe rotary actuator of claim 1, wherein the inlet line is constructed for conducting coolant from an internal combustion engine to the radiator.

4. The fail-safe rotary actuator of claim 3, wherein the thermostat valve comprises a shut-off valve is supported in a valve seat, said thermostat valve having a spring to press the shut-off valve snugly against the valve seat, and a push rod arranged on the shut-off valve, said expansion member configured to actuate the push rod and to expand when a temperature limit of the coolant is reached to thereby lift the shut-off valve away from the valve seat via the push rod in opposition to a pressure applied by the spring.

5. The fail-safe rotary actuator of claim 4, wherein the thermostat valve has chambers arranged on opposite sides of the shut-off valve and acted upon by coolant, with a first one of the chambers receiving coolant from the outlet line, and a second one of the chambers having a fluid communication to a suction port of the pump.

6. The fail-safe rotary actuator of claim 5, wherein the rotary slide valve and the rotary-slide housing define a gap for allowing flow of coolant from the second chamber of the thermostat valve to the suction port of the pump.

7. The fail-safe rotary actuator of claim 2, wherein one of the sub-circuits is a heating circuit, said pump conveying coolant drawn in from the rotary slide valve to the heating circuit and/or a supply line to the internal combustion engine.

8. The fail-safe rotary actuator of claim 7, wherein the heating circuit includes at least one member selected from the group consisting of a heating heat exchanger, heating delivery pump, and heating shut-off valve.

9. The fail-safe rotary actuator of claim 1, further comprising a further shut-off valve arranged in a supply line to an internal combustion engine.

10. The fail-safe rotary actuator of claim 9, wherein the further shut-off valve is configured in the form of a rotary slide valve.

11. The fail-safe rotary actuator of claim 8, wherein the heating shut-off valve is opened, when a temperature limit of the coolant is exceeded so that coolant from the coolant delivery pump is able to flow via the heating heat exchanger to the internal combustion engine.

12. A method of controlling coolant flow in a coolant circuit, comprising:

pumping coolant within a coolant circuit, the coolant circuit having a sub-circuit with an inlet line, and outlet line, and a radiator;

directing coolant flow via a rotary-slide valve situated within a rotary-slide housing, the housing having a plurality of pass-through openings that are fluidly connected to the sub-circuit, the plurality of housing pass through openings including 1) an opening that accepts fluid from the inlet line, 2) an opening that accepts fluid from the outlet line, and 3) an opening that delivers fluid to a pump; rotating said rotary slide valve with respect to said housing to enable at least partial coincidence of the housing pass-through openings with the rotary slide pass-through opening;

detecting whether a temperature of coolant in the inlet line has exceeded a temperature limit with an expansion member of a thermostat valve, said expansion member communicating with coolant in the inlet line by extending into the inlet line; and opening said thermostat valve when coolant exceeds the temperature limit, thus opening a bypass running parallel to the rotary slide, from the outline line directly to the pump.

13. The method of claim 12, wherein the inlet line accepts coolant from an internal combustion engine and wherein the sub-circuit is one of a plurality of sub-circuits.

14. The method of claim 13, further comprising pumping coolant drawn from the rotary slide to a heating circuit or a supply line to the internal combustion engine.

15. The method of claim 13, further comprising 1) exchanging heat in a heating sub-circuit via a heating heat exchanger or 2) pumping coolant in the heating sub-circuit with a heating delivery pump, or 3) actuating a heating sub-circuit shut-off valve.

16. The method of claim 13, further comprising actuating a shut-off valve in a heating sub-circuit, said shut-off valve configured as a rotary-slide valve, said actuation opening a flow path from a heating heat exchanger provided in the heating sub-circuit to the internal combustion engine.

* * * * *